United States Patent [19]

Burgess et al.

[11] 4,103,274

[45] Jul. 25, 1978

[54] RECONSTITUTED METAL OXIDE VARISTOR

[75] Inventors: James F. Burgess, Schenectady; Roland T. Girard, Scotia; Francois D. Martzloff; Constantine A. Neugebauer, both of Schenectady, all of N.Y.

[73] Assignee: General Electric Company, Schenectady, N.Y.

[21] Appl. No.: 722,388

[22] Filed: Sep. 13, 1976

[51] Int. Cl.[2] ..... H01C 7/10

[52] U.S. Cl. ..... 338/21; 29/610 R; 29/621; 252/518; 338/20; 338/327

[58] Field of Search ..... 338/20, 21, 327; 29/610, 621; 427/101; 428/412, 328–330; 252/518, 518.1, 518.3; 260/37 PC

[56] References Cited

U.S. PATENT DOCUMENTS

| | | | |
|---|---|---|---|
| 3,503,029 | 3/1970 | Matsuoka | 338/20 |
| 3,935,157 | 1/1976 | Schiller et al. | 260/37 PC |
| 3,999,159 | 12/1976 | Matsuura et al. | 338/21 |

OTHER PUBLICATIONS

Chemical Abstracts, vol. 85, 1976, p. 571.

*Primary Examiner*—C. L. Albritton

*Attorney, Agent, or Firm*—Lawrence D. Cutter; Joseph T. Cohen; Marvin Snyder

[57] ABSTRACT

Reconstituted metal oxide varistors are formed by hot pressing powdered metal oxide varistor ceramic with plastic resin. Metal electrodes may be pressed directly into the ceramic-plastic composite to provide improved contact characteristics.

25 Claims, 6 Drawing Figures

Fig. 1
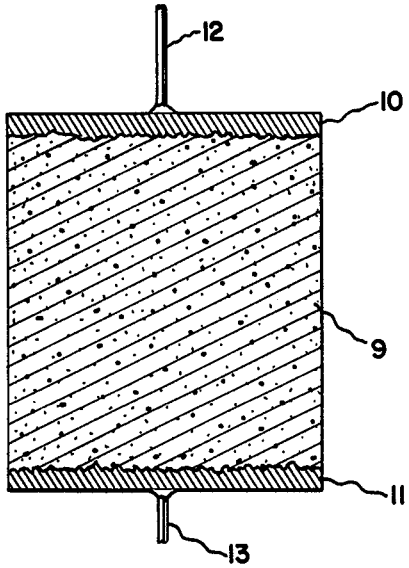
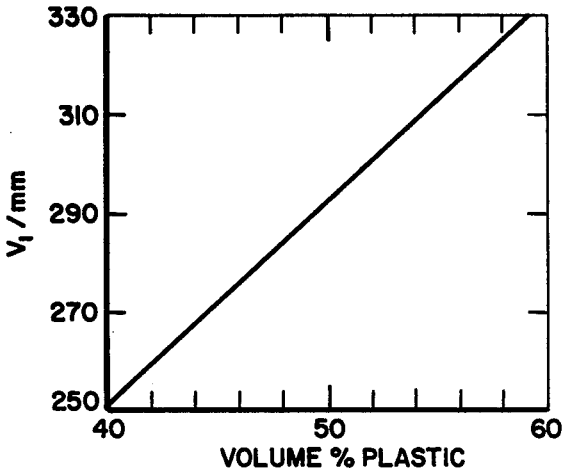
Fig. 2
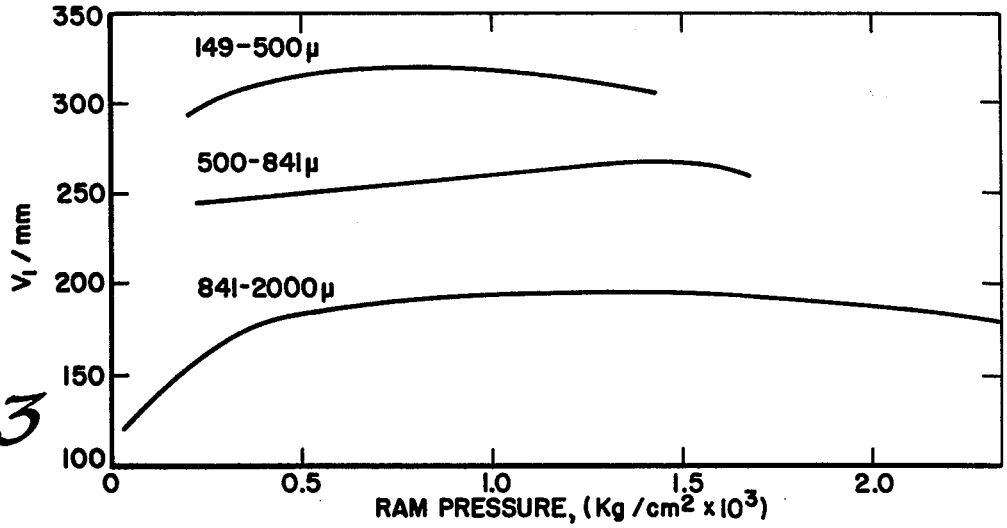
Fig. 3

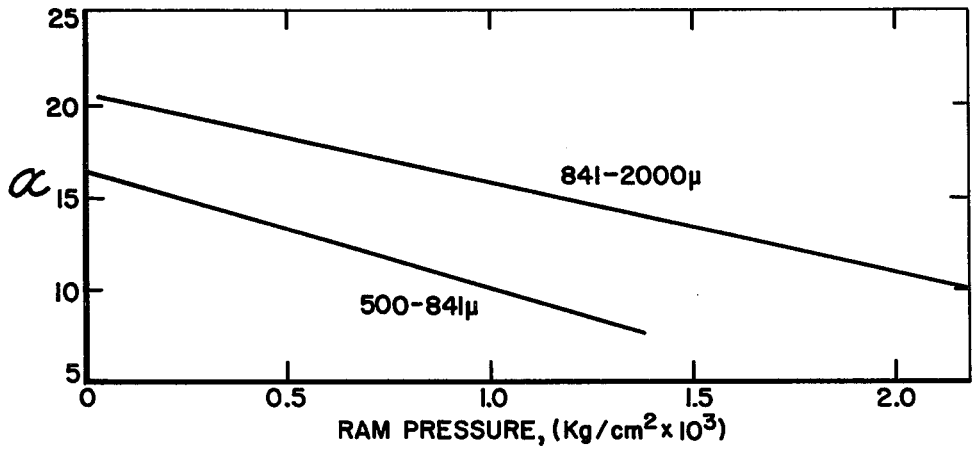
Fig. 4
Fig. 5
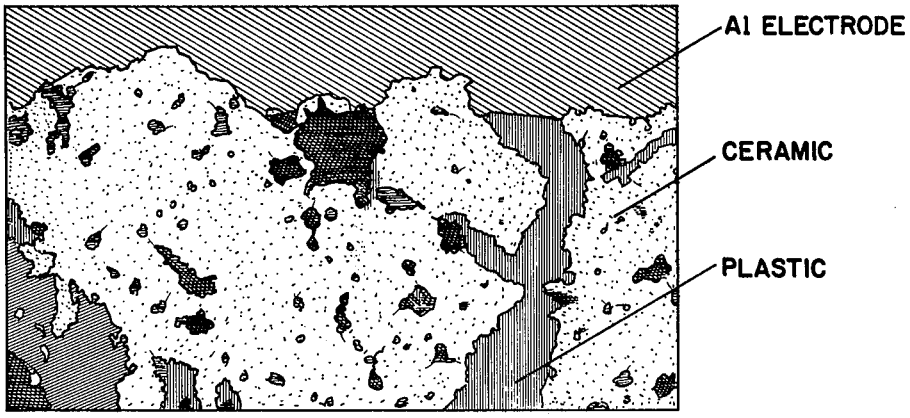
Fig. 6
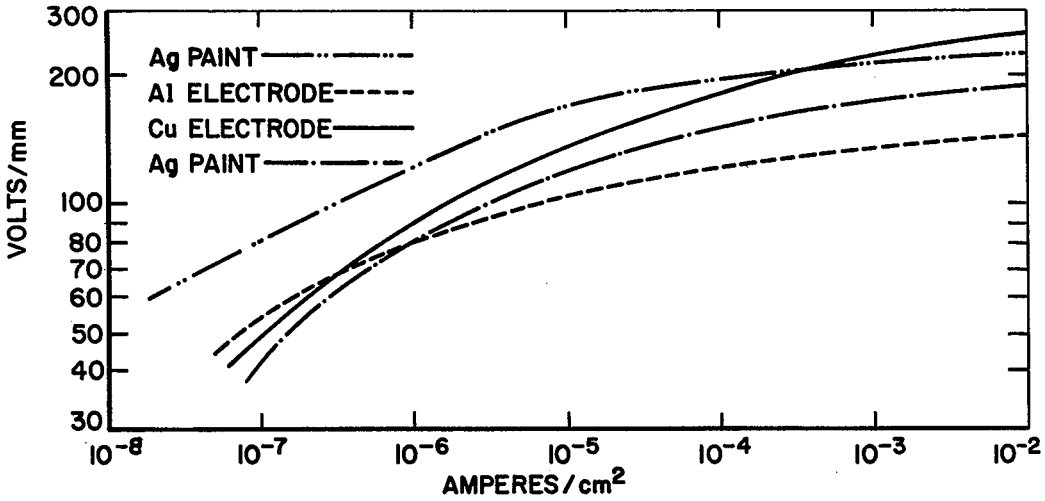

RECONSTITUTED METAL OXIDE VARISTOR

BACKGROUND OF THE INVENTION

This invention relates to metal oxide varistors. More specifically, this invention relates to varistors which comprise a composite of finely ground metal oxide varistor ceramic in a plastic resin matrix.

There are a few known materials which exhibit non-linear resistance characteristics and which require resort to the following equation to relate current and voltage quantatively.

$$I = (V/C)^{\alpha}$$

where V is a voltage between two points separated by a body of the material under consideration, I is the current flowing between the two points, C is a constant, and $\alpha$ is an exponent greater than 1. Materials such as silicon carbide exhibit non-linear or exponential resistance characteristics and have been utilized in commercial silicon carbide varistors, however, such non-metallic varistors generally exhibit an $\alpha$ exponent of not more than six.

Recently, a family of polycrystalline metal oxide varistor materials have been produced which exhibit an $\alpha$ exponent in excess of ten. These new varistor materials comprise a sintered body of zinc oxide crystal grains, including additionally an intergranular phase of other metal oxides and/or halides, for example: beryllium oxide, bismuth oxide, bismuth fluoride, or cobalt fluoride, and are described, for example, in U.S. Pat. No. 3,682,841 issued to Matsuoka et al and U.S. Pat. No. 3,687,871 to Masuyama et al.

The non-linear resistance relationship of metal oxide varistors is such that the resistance is very high (up to at least 10,000 megohms) at current levels in the microampere range, and progresses in a non-linear manner to an extremely low value (tenths of an ohm) at high current levels. The non-linear resistance characteristics result in a voltage versus current characteristic wherein the voltage is effectively limited, the voltage limiting or clamping action being more enhanced at the higher values of the $\alpha$ exponent. Thus, the voltage versus current characteristics of metal oxide varistor material is similar to that of the Zener diode with the added characteristic of being symmetrically bidirectional. The "breakdown voltage" of a metal oxide varistor device is determined by the particular composition of the material and by the distance between the electrodes on the varistor body.

Metal oxide varistors of the prior art are fabricated by pressing and sintering a mixture of metal oxide powder at temperatures in the region of 1300° C to form a generally hard, brittle ceramic body. Circuit components of metal oxide varistor ceramics are generally formed by pressing and sintering disks of the material, applying the electrodes, for example, by painting or screening conductive materials on the surface of the disks, affixing wire leads, and encapsulating the finished component in a suitable dielectric.

It has been suggested that metal oxide varistor ceramics be pressed or machined into complex shapes and bonded to metal terminals and contacts to form specialized circuit components, as for example in U.S. Pat. Nos. 3,742,420 to Harnden and 3,693,053 to Anderson. The manufacture of metal oxide varistors in shapes other than flat disks requires dimensional control, however, which is difficult to attain in a sintering process (due to shrinkage and deformation) and the temperatures encountered in the sintering processes are generally incompatible with common, low cost electrical metals. Machining of sintered parts generally involves grinding brittle materials and is not an economically attractive process for large scale mass production.

Metal oxide varistor components have been formed in the prior art by screening a paste of ground metal oxide varistor ceramic and glass frit on a dielectric substrate and firing to produce a thick film device; as described for example in U.S. Pat. No. 3,725,836 to Wada.

SUMMARY OF THE INVENTION

Varistors are formed by hot pressing a mixture of ground metal oxide varistor ceramic material and plastic resin powder to form a solid composite body. Temperatures utilized in the hot pressing process are much less than those utilized for sintering the ceramic and are generally compatible with low cost metals and contact materials. Complex shapes may be formed with good dimensional stability.

Electrical contacts are most suitably formed on these hot pressed reconstituted varistors by pressing flat aluminum or copper disks or other shapes into the ceramic-plastic material. Insulating films of plastic with high contact resistance, which characterize painted electrical contacts on such devices, are thereby eliminated.

It is, therefore, an object of this invention to provide low cost methods for producing complex shapes from metal oxide varistor materials.

Another object of this invention is to provide metal oxide varistors which incorporate integral metal components.

BRIEF DESCRIPTION OF THE DRAWINGS

The novel features believed characteristic of the present invention are set forth in the appended claims. The invention itself, together with further objects and advantages thereof, may be understood by reference to the following detailed description taken in connection with the appended drawings in which:

FIG. 1 is a reconstituted metal oxide varistor of the present invention;

FIG. 2 is a plot of the breakdown voltage as a function of the plastic content in reconstituted metal oxide varistor bodies;

FIG. 3 is a plot of the breakdown voltage versus the ram pressure utilized to form reconstituted metal oxide varistors;

FIG. 4 is a plot of the $\alpha$ exponent as a function of the ramp pressure used to form reconstituted metal oxide varistors;

FIG. 5 is a tracing of a microphotograph of a pressed metal contact on a reconstituted metal oxide varistor; and FIG. 6 is a plot of voltage gradient versus current density for reconstituted metal oxide varistors which include a variety of metal contact types.

DESCRIPTION OF THE PREFERRED EMBODIMENTS

FIG. 1 is a reconstituted metal oxide varistor of the present invention. A mixture of metal oxide varistor powder and a thermoplastic resin powder is hot pressed, in a method more particularly described in the following examples, to form a solid plug of a reconstituted metal oxide varistor-plastic matrix 9. The plug 9 is, for ease of description, illustrated as a simple square or cylindrical form but it may, of course, assume any complex shape which is suitable for hot pressing by any of the methods which are well known to the plastic fabricating arts.

At least two electrical contacts 10 and 11 are applied to the surface of plug 9, typically on opposing faces and most suitably by hot pressing copper or aluminum disks into the surface of the plug. Alternately, screening, printing, metal evaporation, or any other of the contact-forming techniques which are well known to the varistor arts may be utilized. Wire leads 12 and 13 may, if desired, be attached to the contacts 10 and 11 to provide interconnection with other circuit elements.

Alternately, two or more metal electrodes may be imbedded directly in the body of the plug to form any of the two terminals of the multi-terminal varistor configurations which are known in the art.

EXAMPLE OF A METHOD FOR FORMING A RECONSTITUTED METAL OXIDE VARISTOR-PLASTIC COMPONENT

Pellets of metal oxide varistor materials were formed by sintering a mixture of approximately 97 mol percent zinc oxide, ½ mol percent bismuth oxide and antimony oxide, tin oxide, cobalt oxide, manganese oxide, barium carbonate, and boric acid as approximately 1350° C in the well-known manner of the prior art. The pellets were crushed in a steel die and separated into the following particle ranges.

| Screen Mesh | | Particle Size (micron) | Average Particle Size (micron) |
|---|---|---|---|
| −10 | +20 | 2000–841 | 1420 |
| −20 | +35 | 841–500 | 670 |
| −35 | +100 | 500–149 | 325 |
| −200 | +325 | 74–44 | 59 |

The metal oxide varistor particles were mixed with Lexan$^R$ polycarbonate powder, manufactured by the General Electric Company, Schenectady, New York, and placed in a steel die. The die cavity was a cylinder with an area of approximately 1 cm$^2$. The die plunger had a 0.5 millimeter flat on one side to act as a riser for excess plastic during pressing. The die set was placed on a hot press, without pressure, and given a 10 minute preheat to 220° C. Pressure was then applied to the sample for 5 minutes. The hot die set was then removed from the press and cooled. After removal from the die, the plastic disks were approximately 1 millimeter thick. The faces of the pressed disks were then coated with silver paint contacts and air dried.

Ideally, adjacent varistor ceramic particles in the composite would be in intimate contact and the amount of plastic binder should be no more than that required to fill the empty spaces between the metal oxide varistor particles. The proportion of plastic can be determined experimentally by gradually increasing the proportion of plastic and measuring the thickness of a varistor plug produced under constant die pressure. The volume increases only slowly at first, then, it increases more rapidly with plastic content. For metal oxide varistor particles of approximately 500 microns, this occurs at approximately 50 percent of volume.

The clamping voltage of a reconstituted metal oxide varistor produced from metal oxide varistor powder in the 500 micron to 841 micron range is illustrated in FIG. 2 as a function of the volume percentage of polycarbonate resin. As the resin content increases, the breakdown voltage increases in a substantially linear fashion. This is expected because of the formation of increased plastic barriers between the ceramic particles, adding additional IR drop.

The effect of molding pressure on reconstituted metal oxide varistor-plastic resin plugs is illustrated in FIGS. 3 and 4. FIG. 3 illustrates the relation between the breakdown voltage and molding pressure. Molding pressure has little effect on the breakdown voltage indicating that it does not affect the plastic barriers between the particles. In the measurements of FIGS. 3 and 4, the pressure was applied only during the molding process, when the plastic was liquid, and not during the hardening or electrical measurements.

One must distinguish between two particle sizes in powders produced from ground metal oxide varistor ceramics. First, there is a zinc oxide grain size in a ceramic, generally of the order of about 10 microns.

Secondly, there is a particle size of the metal oxide varistor powder itself, which may be larger or smaller than the grain size. If the particle size is smaller than the zinc oxide grain size, it would be expected to act substantially as a pure zinc oxide particle without an intergranular barrier layer. Thus, no varistor action is to be expected. In a reconstituted metal oxide varistor utilizing this size particle, most of the voltage drop is taken up in the binder material between the particles.

If the particle size is greater than the grain size, the intergranular barrier layer can be expected to remain intact. Thus, in a reconstituted composite, as the particle sizes increase, more of the voltage drop is across the tunneling barriers and less across the binder between the particles. hand, If the particle size is greater than the grain size, one must consider the particle size in relation to the distance between the electrodes in the reconstituted composite. Thus, if the particle size is smaller than the electrode spacing some of the voltage drop will be taken up in the binder between the particles. On the other hand, if the particle size is equal or larger than the electrode spacing there will be only intraparticle voltage drops. The upper curves of FIG. 3 illustrate reconstituted varistors wherein the particles of metal oxide varistor ceramic are larger than the zinc oxide grain size and smaller than the interelectrode spacing. The bottom curve of FIG. 3 illustrates a reconstituted varistor wherein the ceramic particles are of the same order of size as the interelectrode spacing.

FIG. 4 illustrates the dependence of the $\alpha$ exponent of reconstituted varistors as a function of molding pressure. The $\alpha$ exponent for a smaller particle size is lower because of the presence of more plastic barriers between the particles. The effect of molding pressure on alpha exponents is not, however, understood.

METHOD FOR FORMING ELECTRODES ON RECONSTITUTED METAL OXIDE VARISTOR-PLASTIC DEVICES

When using pressed plastic plugs of reconstituted metal oxide varistor material, one problem is to form good electrical contact with the faces of the device. It has been found that it is possible to press metal disks directly into both surfaces of a reconstituted metal oxide varistor-plastic plug to form contacts.

EXAMPLE OF A METHOD FOR FORMING CONTACTS

A 0.01 millimeter metal disk is placed on the bottom of the die and the plastic-metal oxide varistor powder mixture is added. Mold-release compound is sprayed on the plunger and acts as a temporary adhesive for a second 0.01 millimeter metal disk, which is placed on the plunger. The sample is then hot pressed in the manner described above. The resulting plug shows good electrode adhesion and electrical contact. FIG. 5 is a tracing of a microphotograph of an aluminum disk electrode on a reconstituted metal oxide varistor. It may be seen that the ceramic particles in the composite actually penetrate the aluminum electrode at the metal-plastic interface and thus eliminate any thin plastic film which might otherwise form on the plug surface.

FIG. 6 illustrates the electrical characteristics of reconstituted metal oxide varistor-polycarbonate devices produced from ceramic particles in the 841 micron-2000 micron range with conventional painted over silver paste contacts, pressed aluminum contacts, and pressed copper contacts.

In addition to the low cost and ease of processing, the pressed metal contacts have a number of additional advantages. By placing thick metal electrodes on the device, heat sinking is improved at operating power levels. Thus, a device with pressed metal electrodes can be soldered directly into circuits. It is also possible to produce thinner devices with lower clamping voltage because the metal disk contacts are less sensitive to shorting than painted on paste electrodes.

Reconstituted metal oxide varistors may, alternately, be formed in accordance with the present invention by pressing varistor powders in a matrix of thermosetting plastic resin, for example, epoxy resin. It is, in all cases, however, necessary to press the powder-plastic mixture during the forming process, to assure intimate contact between at least a fraction of adjacent varistor particles.

Reconstituted metal oxide varistors of the present invention may be formed in more complex shapes and at lower cost than conventional sintered ceramic disk varistors. The process temperatures are compatible with conventional electrical metals and allow the production of complex devices, incorporating metal components, in large quantity. Pressed electrodes of the present invention provide better electrical contact and improved heat sinking over the painted electrodes of the prior art.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

The invention claimed is:

1. A reconstituted metal oxide varistor comprising a composite of metal oxide varistor ceramic particles in a plastic resin matrix.

2. The varistor of claim 1 wherein adjacent ceramic particles in said composite are in intimate physical contact.

3. The varistor of claim 1 wherein said composite comprises a quantity of thermoplastic resin which is at least sufficient to fill voids between said ceramic particles.

4. The varistor of claim 1 wherein the metal oxide varistor ceramic comprises a sintered mixture of zinc oxide, bismuth oxide, and other metal oxides.

5. The varistor of claim 1 wherein the resin comprises polycarbonate plastic.

6. The varistor of claim 1 further comprising at least one metal electrode in contact with said composite.

7. The varistor of claim 6 wherein said electrodes comprise metal sheet members in contact with at least one surface of said composite.

8. The varistor of claim 7 wherein said metal sheets comprise copper.

9. The varistor of claim 7 wherein said metal sheets comprise aluminum.

10. The varistor of claim 6 wherein adjacent ceramic particles penetrate said metal electrodes.

11. The varistor of claim 6 wherein said electrodes comprise conductive metal paste applied to the surface of said composite.

12. The varistor of claim 6 comprising two electrodes on the faces of said varistor body.

13. A method for forming a reconstituted metal oxide varistor comprising the steps of:

forming a powder from particles of a metal oxide varistor ceramic;

mixing said powder with a plastic resin; and pressing said mixture to form a solid composite body.

14. The method of claim 13 wherein the ratio of ceramic powder to plastic resin in said mixture is sufficient to allow intimate physical contact between adjacent ceramic particles in said composite body.

15. The method of claim 13 wherein said mixture contains sufficient plastic resin to fill voids between ceramic particles in said composite body.

16. The method of claim 13 wherein said plastic resin comprises polycarbonate.

17. The method of claim 13 wherein said varistor ceramic comprises a mixture of zinc oxide, bismuth oxide, and other metal oxides.

18. The method of claim 13 wherein said plastic resin is mixed with said ceramic in powdered form.

19. The method of claim 13 wherein said pressing is accomplished at a pressure below approximately $2 \times 10^3$ kg/cm$^2$.

20. The method of claim 13 wherein said pressing is accomplished at a temperature of approximately 220° C.

21. The method of claim 13 wherein said metal oxide varistor ceramic powder has a particle size between approximately 44 microns and approximately 200 microns.

22. The method of claim 13 further comprising the step of pressing metal electrodes into said solid body.

23. The method of claim 22 wherein said metal electrodes comprise copper.

24. The method of claim 22 wherein said metal electrodes comprise aluminum.

25. The method of claim 22 wherein said metal electrodes are metal sheets and said pressing step comprises hot pressing said metal sheets into at least one surface of said solid body.

* * * * *